US005632335A

United States Patent [19]

Campbell et al.

[11] Patent Number: 5,632,335

[45] Date of Patent: May 27, 1997

[54] WELL TUBING AND PUMP ROD PROTECTOR

[76] Inventors: Wallace R. Campbell, P.O. Box 2005, Universal City, Tex. 78148; Dennis W. Gilstad, 3522 Hunters Sound, San Antonio, Tex. 78230

[21] Appl. No.: 541,367

[22] Filed: Oct. 10, 1995

[51] Int. Cl.[6] ..... E21B 17/10; E21B 43/00

[52] U.S. Cl. ..... 166/105; 166/242.1; 166/242.6; 417/545

[58] Field of Search ..... 166/68, 105, 242.1, 166/242.6, 369; 417/545

[56] References Cited

U.S. PATENT DOCUMENTS

| | | | |
|---|---|---|---|
| 1,624,798 | 4/1927 | Neilson | 417/545 |
| 2,432,028 | 12/1947 | Mackin | 417/545 X |
| 3,013,793 | 12/1961 | Howell et al. | 166/105 X |
| 4,139,334 | 2/1979 | Payne et al. | 417/545 |
| 4,585,368 | 4/1986 | Pagan | 166/68 X |
| 4,905,760 | 3/1990 | Gray | 166/105 X |

OTHER PUBLICATIONS

"Sucker Rod Guides," LTV Energy Products brochure, Oil States Industries Division, Oilfield Products, Arlington, TX, pp. 12–13 (undated).

"Sucker Rod Guides," Regal® Oilfield Products brochure (undated).

Various J.M. Huber Corporation brochure pages (undated).

*Primary Examiner*—George A. Suchfield

*Attorney, Agent, or Firm*—Akin, Gump, Strauss, Hauer & Feld, L.L.P.

[57] ABSTRACT

An improved rod guide which reduces flow resistance by flow-through design and by reducing fluid turbulence. Incremental flow velocity changes result from progressive changes in fluid path direction and cross-sectional area. Large bearing surfaces and a predetermined compliance to bending along the longitudinal axis provide for low bearing loads and long service life. Preferred embodiments may comprise features to absorb lateral shock loads and to streamline fluid flow, further reducing turbulence and flow resistance. The guides are adapted for efficient hot-oiling and preferred embodiments incorporate automatic rotation features for extended service life in relatively straight well bores. Embodiments of the improved rod guide for use in strongly curved well bores tend to be self-aligning in a preferred position to absorb the shock of changes in pump rod direction of movement.

27 Claims, 6 Drawing Sheets

WELL TUBING AND PUMP ROD PROTECTOR

BACKGROUND

1. Field of the Invention

The present invention relates generally to lift pumps used in drilled wells, and specifically to methods and apparatus for pump stabilization and for reducing wear due to sliding contact between lift pump rods and well tubing.

2. Well Drilling and Lift Pumps

Fluids such as water and oil are often recovered by lift pumps from wells drilled in the earth. Lift pumps operate through a reciprocating pump rod within the well tubing; the pump rod may be driven, for example, by a pump jack or windmill positioned over the well. Being relatively inexpensive to buy and operate, lift pumps are widely used for crude oil recovery. For ideal operation, however, the pump rod must remain approximately centered within the well tubing as it moves, thus avoiding sliding contact with the tubing wall which could cause excessive wear of the tubing, the pump rod, the pump or all three. A curved or non-vertical well bore makes undesirable rod-wall contact more likely.

Since no drilled well is precisely straight, rod-wall contact is at least a potential problem in virtually all drilled wells. Where a well head can not be placed directly over the oil deposit, a curved well bore may be drilled intentionally to reach the oil. In such cases, well bore curvature has been increased to as much as 16 degrees per 100 feet of length. On the other hand, even when a straight vertical well is desired, bore curvature can not be totally eliminated. In nominally straight wells, bore curvature actually varies in degree and direction throughout the entire depth of the well.

In wells where bore curvature is intentionally maintained in a single predetermined direction, deviation of the well bore from vertical increases with well depth. A well may be drilled in which the upper portion of the well bore is approximately vertical while the portion below the kick-off point is deviated to a virtually horizontal orientation. In such a well, a lift pump is generally not placed in intentionally deviated portions of the well bore (that is, below the bore kick-off point) because of difficulty in keeping the pump rod from striking the wall. And even in the relatively straight upper portions of such wells, bore curvature is still large enough so that pump rods tend to contact the surrounding tubing wall, especially in relatively deep wells. Additionally, buckling of the rod string on the pump jack down stroke and buckling of the well tubing on the upstroke also tend to cause rod-wall contact.

Regardless of the cause, rod-wall contact results in friction and wear that wastes power during pumping and leads to premature equipment failure and unnecessary cost and delay. An example of equipment damage is that caused to pump seals and bearings due to lateral forces and vibration induced by rod-wall contact. Additionally, frictional wear on rods and tubing may cause pump rods to part and/or it may cause a tubing string to part with the lower section falling to the well bottom.

To avoid these and similar problems, rod guides in the form of split collars or radial standoffs have been applied to the rod string to occupy the space between the rod and the tubing. While the collars effectively prevent rod-wall contact over a limited length of rod, they generally add significantly to the frictional work required to pump the well. They may also substantially restrict the flow of fluid past the collars and increase fluid turbulence, both effects causing significant increases in lift pump back pressures when a rod string is lowered into a well. Excessively high pump back pressures tend to lead to premature failure of pump valves.

Radial standoffs may present less fluid flow resistance than split collars, but they still induce significant fluid turbulence and also generally have less wall contact area than a comparable length split collar. Thus, guide-wall bearing surface pressures tend to be higher with radial standoffs than with split collars, resulting in relatively greater wear. If radial standoffs are lengthened to achieve lower bearing surface pressures, the resistance to fluid flow increases in direct proportion to the length. Both split collars and radial standoffs also tend to slip on the rods due to wall friction forces in combination with their relatively high flow resistance, the latter effect causing significant dynamic pressure differentials across each guide. Split collars and radial standoffs are often made of relatively compliant materials, such as plastic or rubber, which provide shock absorption during movement of the rod string. But these relatively soft materials also tend to wear relatively quickly.

Notwithstanding these problems, wells that are both deep and significantly deviated are often drilled to recover oil sequestered in isolated underground deposits or lying under populated areas. A typical well of this kind was drilled near Giddings, Tex. in 1994. The well bore has a substantially vertical upper portion of about five thousand feet and a total vertical depth of about seven thousand feet, but the total bore length is about sixteen thousand feet. In this well, a lift pump is located near the kick-off point (the five thousand foot level), and more than nine hundred rod guides are required between the pump and the well head. Rod guide replacement in such a well is a major expense. And because of the cumulative friction of so many guides on the well tubing, rod rotators can not be used to encourage even wear. Consequently, holes may be worn in the tubing which then allow fluid circulation below the surface.

Pumping of Viscous and Corrosive Fluids

The increased flow resistance associated with split collars and radial standoffs becomes even more pronounced when viscous fluids are considered. Such fluids are common in crude oil recovery, and they often contain significant quantities of paraffin-like substances which may solidify on the spacers and further restrict fluid flow past them. Paraffin build-up may not be a problem in the lower portions of deep oil wells because temperatures exceeding 150 degrees Fahrenheit keep the paraffin liquified, but in general paraffin is destructive to both down hole and surface equipment (rods, tubing, pump and flow line). In particular, as the oil rises to the surface, it cools. Paraffin in the oil then begins to solidify at a portion of the well called the cloud point, which varies somewhat with the composition of the crude oil being recovered. Pump rod spacers located at or above the cloud point may easily become fouled with solidified paraffin-like substances, substantially increasing fluid flow resistance. To maintain well production, oil heated to about 325 degrees Fahrenheit may be periodically pumped down the well to melt the paraffin, but such "hot oiling" can shorten the service life of certain polymers currently used in rod guides.

A further complication of many oil recovery operations is the presence of significant quantities of hydrogen sulfide gas and water mixed with the crude oil. This combination is highly corrosive and can rapidly degrade the quality of finished metal surfaces and other materials exposed to it. Similarly, electrolytic currents between dissimilar metals can destroy components of the well and/or pumping system.

Thus, a rod guide is needed which will provide an adequate bearing surface in contact with the well tubing without imposing an undue friction load on the pump jack, even in curved bores. Further, spacers should be about as corrosion-resistant as well tubing and designed for low fluid flow resistance (including minimum fluid turbulence). Finally, spacers should be relatively resistant to fouling with solidified paraffin-like substances, adapted for efficient hot oil treatment when required, and characterized by a long service life.

SUMMARY OF THE INVENTION

The present invention includes an improved rod guide known as a well tubing and pump rod protector which imposes a relatively low friction load, even in curved well bores, and is corrosion-resistant and long-wearing. Fluid flow resistance through the improved rod guide is relatively low due to a flow-through design and due to reduced turbulence in a fluid stream passing through the guide. Incremental flow velocity changes through the improved rod guide, rather than abrupt changes associated with turbulence, result from progressive changes in fluid path direction and cross-sectional area. The flow-through design also reduces susceptibility to paraffin fouling and assists movement of paraffin from the cloud point to the surface by improved scavenging along a relatively smooth fluid path. Preferred embodiments of the improved rod guide have substantially all-metal construction consistent with standard down hole equipment to minimize incompatibility which might lead to electrolytic damage. Such guides are thus particularly adapted for efficient hot oil cleaning of accumulated paraffin.

A long service life results from a relatively large outer beating surface area (for relatively low bearing loads), outer bearing surface diameter being chosen to provide an effective bearing surface on the inner wall of well tubing in which the guide moves longitudinally. In certain preferred embodiments, a large bearing area is substantially equally divided into two bearing portions coupled by attenuated bearing regions or adjustable elongated members to increase Coy a predetermined amount) compliance to bending along a longitudinal axis. Preferred embodiments may comprise features to streamline fluid flow, further reducing turbulence and flow resistance. Streamlining features on rod guides also substantially reduce wear on stuffing box washers and similar seals, as well as reducing friction loads as rod guides move over scale and other debris which may accumulate on the tubing wall. Preferred embodiments may also incorporate automatic self-rotation features for extended service life in relatively straight well bores. For strongly curved well bores, preferred embodiments of the improved rod guide tend to be self-aligning in a preferred position to absorb the shock of changes in pump rod direction of movement and to substantially distribute bending forces along the length of the guide. Thus, even in difficult operating conditions, improved rod guides provide superior pump stabilization.

An improved rod guide comprises an elongated and substantially hollow outer bearing member (preferably substantially comprising high-strength plastic or metal such as mild steel) having a substantially right circular cylindrical outer bearing surface and first and second ends. Mild steel is preferred as the predominant structural material in many embodiments because of its relatively low cost; it is also relatively long-wearing, has corrosion-resistance comparable to the well tubing, and does not promote significant electrolytic currents with well tubing of substantially similar material.

The outer bearing surface may be steel, for example, or may further comprise an outer layer of relatively high temperature (for example, copper-base) bearing alloy or steel treated with a lubricant such as molybdenum disulfide, or a layer of (optionally fiber reinforced) plastic material preferably having a yield point above 325 degrees Fahrenheit. Certain preferred embodiments additionally comprise self-rotation means comprising at least one internal vane fixed to the outer bearing member with sufficient transverse orientation to impart a desired self-rotational force to the outer bearing member during substantially longitudinal flow of fluid through the outer bearing member (and past the internal vane). Outer bearing members have a diameter sized to create an effective sleeve bearing when the outer bearing member is inserted in a portion of well tubing. In certain applications, for example, outer bearing members will preferably be sized to provide about 0.050 inch to about 0.070 inch clearance between the well tubing wall and the outer bearing surface. In other applications, the preferred clearance may be either larger or smaller.

Outer bearing member length is measured along a longitudinal axis between the first and second ends. First and second rod bearing means are spaced apart along the longitudinal axis, each being fixed by respective first and second centering means (each centering means comprising, for example, a substantially solid rod bearing support block or at least one rod bearing standoff) substantially coaxially within the outer bearing member surface adjacent the first and second ends respectively. In certain embodiments, the outer bearing member comprises first and second corresponding portions to which are fixed the first and second rod bearing means respectively, the first and second corresponding portions being (preferably compliantly) coupled longitudinally, either reversibly or substantially permanently.

Rod bearing standoffs are preferably substantially longitudinally oriented sheet-like structures which securely (but optionally resiliently) fix rod bearing means to the outer bearing member while offering relatively low resistance to substantially longitudinal fluid flow through spaces between the standoffs. Note that one or more rod bearing standoffs, while oriented substantially longitudinally, can simultaneously have sufficient transverse orientation (as, for example, a helix with a pitch-to-diameter ratio greater than about 2) to function as an internal vane, imparting rotational forces to the outer bearing member during substantially longitudinal fluid flow through fluid paths bounded by the outer bearing member, the rod bearing means, and at least one rod bearing standoff.

Each rod bearing means comprises a substantially tubular longitudinal bore (that is, a rod bearing bore) with a longitudinal rod bearing gap for allowing substantially lateral insertion of a pump rod within the rod bearing bore. The rod bearing gap size may be specified at each point along the tubular longitudinal rod bearing bore as the angular size of a sector occupied by the gap in a transverse circle centered within the tubular longitudinal rod bearing bore. The sector (gap size) is preferably about 90 degrees to about 180 degrees, and may vary along the rod bearing bore length. Rod bearing gap sizes less that 180 degrees may require some temporary deformation of the rod bearing bore (that is, temporary spreading of the rod bearing gap) to allow substantially lateral insertion of a pump rod, depending on the rod diameter. For rod diameters nearly equal to the rod bearing bore diameter, the gap size may be non-uniform along the rod bearing bore length, preferably being greater at one end of the rod bearing bore than at the other end, thus facilitating insertion of a rod into the rod bearing bore by starting the insertion where the gap is largest. Note that for gap sizes less than 180 degrees, the rod bearing bore acts as a longitudinal clip, tending to retain a pump rod within the bore after it is inserted. This retention tendency may be augmented for each rod bearing bore with rod retainer means, preferably comprising one or more transverse retainers reversibly and adjustably coupling the opposite edges of a tubular rod bearing bore which border the substantially longitudinal rod bearing gap (as through screw fastener means comprising at least one screw fastener such as a screw, bolt and/or U-bolt). Transverse retainers preferably act as beating caps which can function in connection with the rod beating bore to provide both longitudinal bearings to facilitate rotation of a rod guide about a pump rod, and thrust bearings to limit movement of a rod guide longitudinally along the pump rod. All screw fasteners used in the improved rod guide will preferably comprise one or more conventional locking features such as split nuts, locking inserts in nuts, lock washers and/or polymer-based locking compounds to reduce the likelihood of such fasteners coming loose during well operation.

Once a pump rod is inserted in a tubular rod bearing bore of an improved rod guide, the outer bearing surface to which the rod bearing bore is fixed may be relatively free to rotate longitudinally about the pump rod, depending on the predetermined clearance between the rod bearing bore and the rod. Such free rotation would be desirable in embodiments comprising self-rotation means. If, on the other hand, the clearance is less than zero (that is, an interference fit), the outer bearing surface will be effectively (and reversibly) fixed to the pump rod. This fixing may be desirable to reduce or prevent longitudinal slipping of the rod guide along a rod within a well, and such fixing substantially prevents free rotation of the outer bearing member with respect to the rod. Thus, such fixing may be useful for rod stabilization near the top of a pump, and where an external rod rotator is used in a well to minimize localized wear on guides and/or the well tubing.

In other preferred embodiments, the outer bearing member may be substantially (and preferably symmetrically) truncated by first and second planes. The planes may be flat or curved. The first plane passes through at least a portion of the first end and at least a portion of the outer bearing surface to define a first truncated region of the outer bearing surface. Similarly, the second plane passes through at least a portion of the second end and at least a portion of the outer bearing surface to define a second truncated region of the outer bearing surface. The first and second tubular longitudinal rod bearing bores are truncated by the first and second truncating planes respectively substantially flush with or within the outer bearing surface. Since the first and second truncating planes pass substantially longitudinally through the first and second tubular rod bearing bores respectively, first and second rod bearing gaps are created.

Where substantially solid first and second rod bearing support blocks are used, streamlining means (such as a cowling or ramp-like surface) may extend from at least a portion of the first and second outer bearing member ends adjacent the support block to proximate the surface of an axial rod lying within the improved rod guide. If the axial rod is a poney rod, the streamlining means may extend from the first and second outer bearing member ends to the respective junctions between the tapered areas and wrench areas (that is, the first and second transition zones, respectively). Besides smoothing fluid flow around and through an improved rod guide, streamlining means help displace resilient rod packing materials without damage when a rod guide moves through the materials. Streamlining means also tend to reduce gouging of materials such as scale and/or debris adherent to tubing walls as the improved rod guide moves through the tubing.

DETAILED DESCRIPTION

Figure 1A:
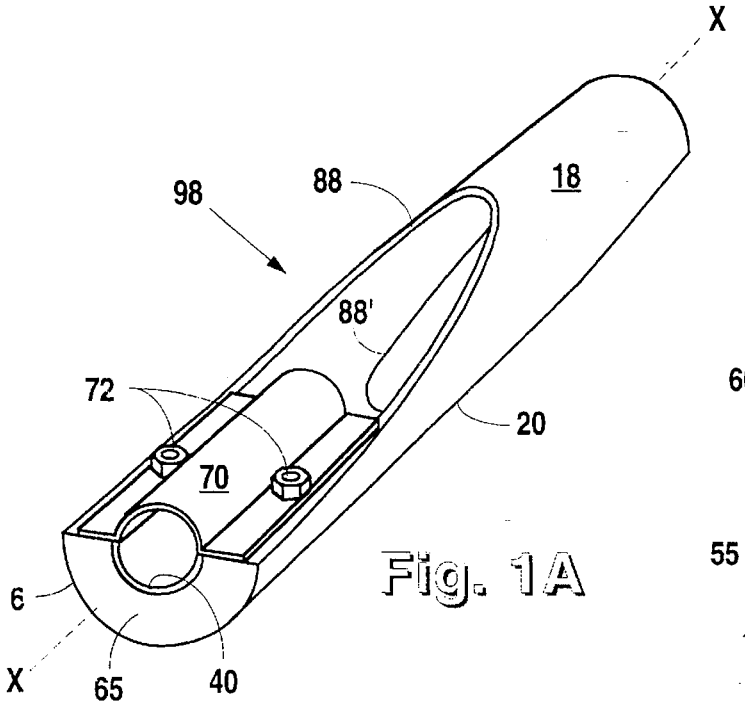
FIG. 1A schematically illustrates an isometric view of one end of a symmetrically truncated embodiment of a well tubing and pump rod protector (an improved rod guide) having a substantially solid rod bearing support block.

Referring to the Figures, the embodiments of the improved rod guide called the well tubing and pump rod protector 98,99 which are schematically illustrated include an improved rod guide embodiment 98 which comprises a substantially hollow outer beating member 20 having an outer bearing surface 18 which is substantially symmetrically truncated along edges 88,88'. In another embodiment of the improved rod guide 99, outer bearing surface 18' is substantially divided between first and second corresponding portions 22,22' of substantially divided outer bearing member 23.

Substantially hollow outer bearing member 20,23 has a substantially fight circular cylindrical outer bearing surface 18,18' a first end 6,6' and a second end 8,8', a longitudinal axis X—X, and a length L,L' measured along the longitudinal axis X—X between the first end 6,6' and the second end 8,8'. First and second rod bearing means are spaced apart along the longitudinal axis X—X and fixed substantially coaxially within the outer bearing member 20,23 adjacent the first end 6,6' and the second end 8,8' respectively. First and second centering means are provided for fixing the first and second rod bearing means respectively substantially coaxially within the outer bearing member surface 18, 18'

Figure 3A:
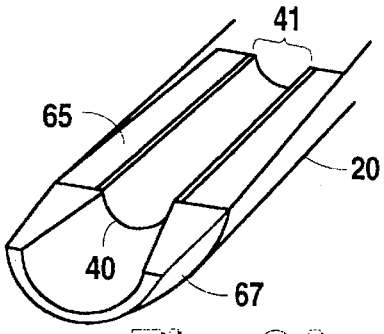
FIG. 3A schematically illustrates an isometric view of one end of a symmetrically truncated embodiment of an improved rod guide having a substantially solid rod bearing support block and streamlining means.
Figure 3B:
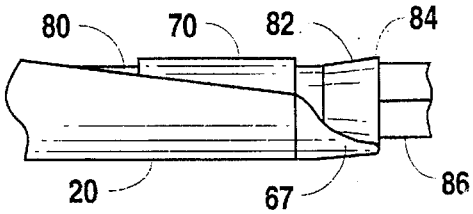
FIG. 3B schematically illustrates a side elevation of one end of a symmetrically truncated embodiment of an improved rod guide with streamlining means over a pump rod.
Figure 9:
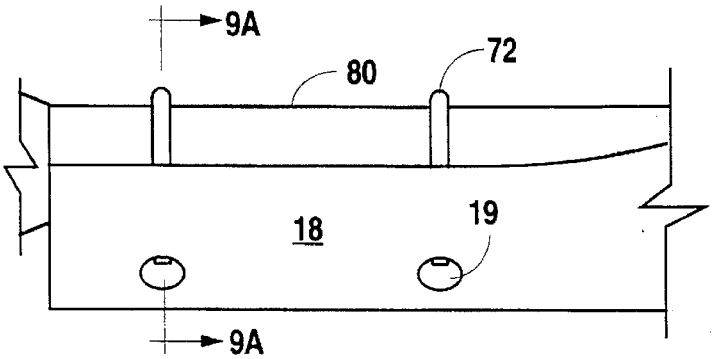
FIG. 9 schematically illustrates a portion of a pump rod coupled to a portion of an improved rod guide by U-bolts.
Figure 9A:
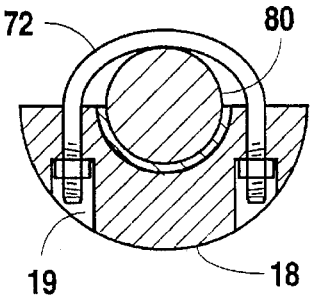
FIG. 9A schematically illustrates a cross-section of the coupled rod and rod guide of FIG. 9 showing countersinking of the U-bolt nuts and threaded portions below the outer bearing surface 18.

Each centering means may comprise at least one rod beating standoff 60 and/or at least one resilient rod bearing standoff 50 and/or a substantially solid rod bearing support block 65. In the latter case, the improved rod guide 98,99 may additionally comprise streamlining means such as ramp-like surface 67 extending from at least a portion of the first outer bearing member end 6,6' and the second outer bearing member end 8,8' toward (but not necessarily touching) a substantially coaxial pump rod 80,80'. FIG. 3A schematically illustrates ramp-like surface 67 extending from an outer bearing member end and shaped internally so as to substantially conform to the tapered area 82 of a pump rod 80, with the ramp-like surface 67 terminating proximate transition zone 84 (which lies between tapered area 82 and wrench area 86 as in FIG. 3B). Each of the rod bearing means comprises a substantially tubular longitudinal bore 40,40' having a longitudinal rod bearing gap 41,41' for allowing substantially lateral insertion of a pump rod 80,80' within each rod beating bore 40,40' and may additionally comprise rod retainer means. When rotation (especially self rotation) of improved rod guide 98,99 about pump rod 80,80' is desired, retainer means preferably comprise one or more transverse retainers 70,70' reversibly and adjustably coupling the opposite edges of a tubular rod bearing bore 40,40' which border the substantially longitudinal rod bearing gap 41,41'. Transverse retainers 70,70' preferably couple the opposite edges of a tubular rod bearing bore 40,40' through screw fastener means 72, comprising at least one screw fastener such as a screw, bolt or U-bolt). Transverse retainers 70,70' provide bearing surfaces relative to pump rod 80,80' complementing those of rod bearing bores 40,40' respectively. Note that when screw fastener means comprise one or more U-bolts, holes 19 to accommodate the U-bolt nuts and threaded portions are countersunk below outer bearing surface 18. Note also that when rotation (especially self rotation) of improved rod guide 98,99 about pump rod 80,80' is not desired, rod retainer means may comprise one or more U-bolts, having nuts countersunk as above, but without transverse retainers 70,70' (see FIGS. 9 and 9A).

Figure 5A:
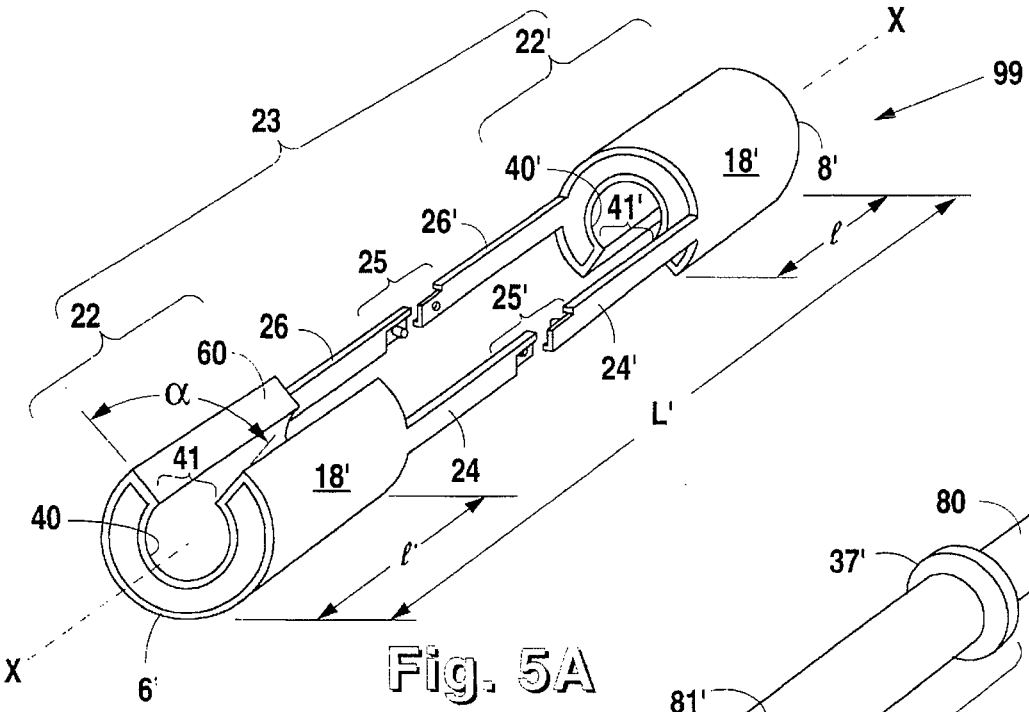
FIG. 5A schematically illustrates an embodiment of the improved rod guide comprising reversibly coupled first and second corresponding portions of the outer bearing member.
Figure 5B:
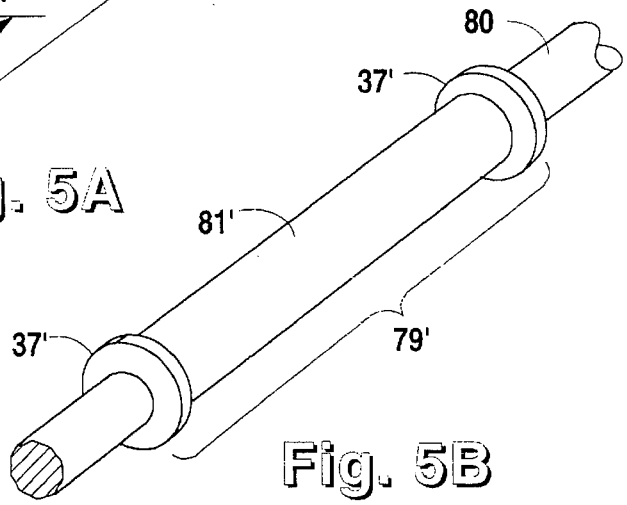
FIG. 5B schematically illustrates an inner beating race and two thrust bearings cast around a portion of a pump rod.
Figure 5C:
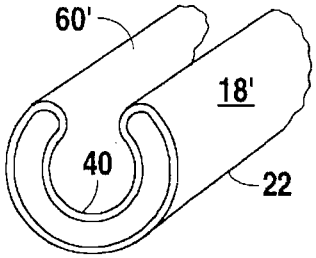
FIG. 5C schematically illustrates one end of an improved rod guide formed from a single tube.
Figure 5D:
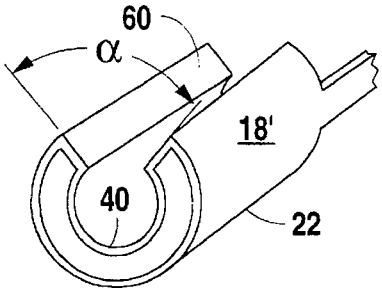
FIG. 5D schematically illustrates one end of an improved rod guide having a non-uniform rod bearing gap.
Figure 5E:
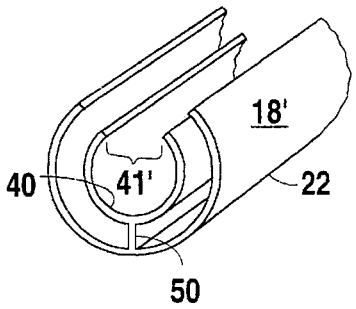
FIG. 5E schematically illustrates one end of an improved rod guide having a tubular rod bearing bore fixed to the outer bearing member by a single rod bearing standoff.
Figure 5F:
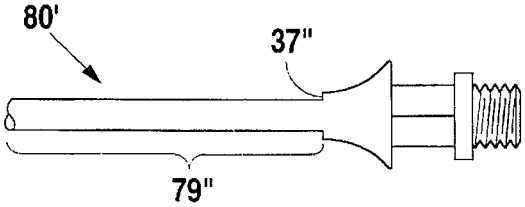
FIG. 5F schematically illustrates one end of a modified pump rod having an inner bearing race and thrust bearing.

Each rod bearing gap 41,41' has a gap size alpha,alpha' respectively measurable at each point along the tubular longitudinal rod bearing bore length l,l' respectively. Note that for relatively straight well bores, l is preferably substantially equal to l'. On the other hand, for strongly curved and/or nonvertical well bores where lateral pump rod forces are substantially nonsymmetrical and rod guides tend to be self-aligning (or where they can be rotationally aligned from the surface), a longer rod bearing bore may be desired on one end of the rod guide to accommodate relatively larger lateral forces without resulting in excessive wear on the rod bearing bore. The gap size alpha,alpha' is specified as the angular size of a sector occupied by the gap 41,41' respectively in a transverse circle centered within the rod bearing bore 40,40' respectively. The rod bearing gap size alpha,alpha' is preferably about 90 degrees to about 180 degrees and may be non-uniform as schematically illustrated in FIG. 5D.

In embodiments of the improved rod guide 99 where outer bearing surface 18' is substantially divided between first and second corresponding portions 22,22' of substantially divided outer bearing member 23, first and second rod bearing gaps 41,41' are preferably rotationally misaligned from each other for reasons given below.

A rod bearing means may additionally comprise an inner rod beating race 79,79',79" and two thrust bearings 37,37', 37" spaced apart so as to bear on the rod bearing bores 40,40' to facilitate rotation of the improved rod guide 98,99 about a pump rod 80,80' while limiting longitudinal motion of the rod guide along the pump rod.

Figure 1B:
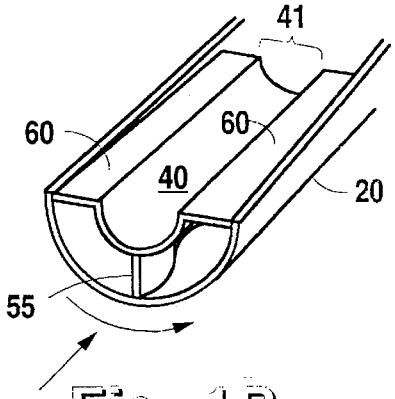
FIG. 1B schematically illustrates an isometric view of one end of a symmetrically truncated embodiment of an improved rod guide having rod bearing standoffs.

Having provided for rotation of the well tubing and pump rod protector 98,99 about a pump rod 80,80', the protector 98,99 may preferably comprise at least one rod bearing standoff 55 oriented substantially longitudinally but with sufficient transverse orientation to function as an internal vane for imparting rotational forces (see counterclockwise arrow in FIG. 1B) to the outer bearing member 20,23 during substantially longitudinal fluid flow (see longitudinal arrow in FIG. 1B) through fluid paths bounded by the outer bearing member 20,23, the tubular rod bearing bore 40,40', and said at least one rod bearing standoff 55.

As noted above, the outer bearing member 20,23 may substantially comprise first and second corresponding portions 22,22' to which are fixed the first and second rod bearing means respectively, and may further comprise a reversible coupling means 25,25' which preferably facilitates coupling between the corresponding portions 22,22' such that first and second rod bearing gaps 41,41' are rotationally misaligned. The corresponding portions 22,22' may alternatively be substantially permanently coupled (see FIG. 6B), with the outer bearing member comprising an attenuated portion 28 (for a predetermined increase in longitudinal compliance) between the first and second corresponding portions. In still another embodiment, the corresponding portions may be joined by adjustable elongated members 27 (such as, for example, threaded rods) for increased (predetermined) longitudinal compliance.

Figure 2A:
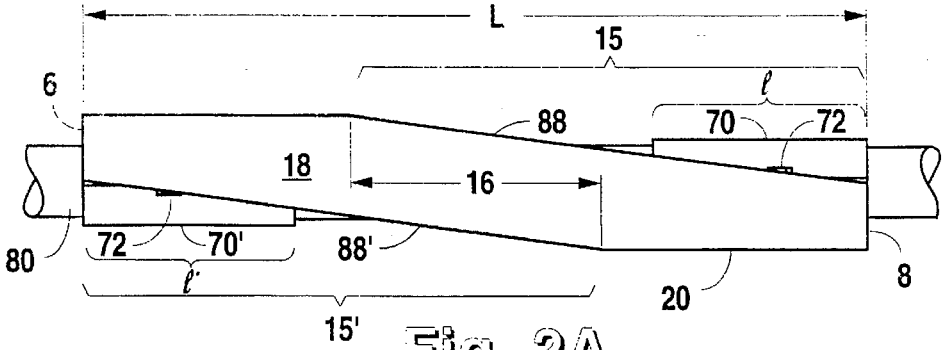
FIG. 2A schematically illustrates a side elevation of a symmetrically truncated embodiment of an improved rod guide over a pump rod.
Figure 2B:
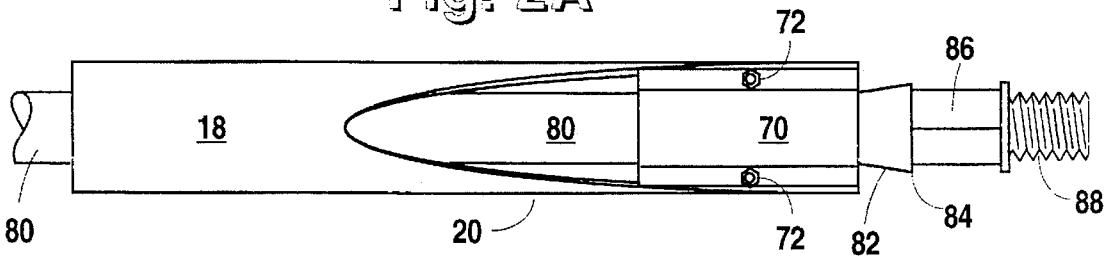
FIG. 2B schematically illustrates a plan view of a symmetrically truncated embodiment of an improved rod guide over a pump rod.

As noted above, certain embodiments of the well tubing and pump rod protector 98 comprise an outer bearing member 20 which is (preferably substantially symmetrically) truncated by first and second planes, which may be curved, angled (see FIG. 6C) or substantially flat (see FIG. 2A). The first plane passes through at least a portion of the first end 6 at least a portion of the outer bearing surface 18 to define a first truncated region 15 of the outer bearing surface 18, and the second plane passes through at least a portion of the second end 8 and at least a portion of the outer bearing surface 18 to define a second truncated region 15' of the outer bearing surface 18. The first and second tubular longitudinal bores 40,40' are truncated by the first and second truncating planes respectively substantially flush with (or within) the outer bearing surface 18, the first and second truncating planes passing substantially longitudinally through the first and second tubular longitudinal bores 40,40' respectively. The first and second truncated regions 15,15' of the outer bearing member 20 may overlap longitudinally (see region 16 on FIG. 2A and 6C).

The present invention also includes a section of well tubing 95 containing the well tubing and pump rod protector 98,99 and a pump rod 80,80', as well as a pump rod 80,80' to which is fixed at least one well tubing and pump rod protector 98,99.

Each of the improved rod guides 98,99 of the present invention aid in maintaining a pump rod 80,80' substantially coaxial in the bore of a section of well tubing 95. However, fixing of a pump rod 80,80' within a tubular rod bearing bore 40,40' in a substantially coaxial position with respect to the outer bearing member surface 18,18' does not necessarily imply a total absence of substantially lateral movement of the rod 80,80' with respect to the outer bearing surface 18,18' and the wall of the well tubing 95. One or more resilient rod bearing standoffs 50 may comprise spring steel for example, allowing relatively small and substantially lateral movements of the rod with respect to the bearing surface which temporarily deform the resilient standoff(s) 50, after which the standoff(s) 50 return to their original shape. Such movements can act to reduce shock loading of the outer bearing surface 18,18' during, for example, changes in the direction of longitudinal movement of the pump rod 80,80'. Analogously, use of resilient materials such as rubber or other polymers in substantially solid rod bearing support blocks 65 can provide for similar shock-absorbing action which can tend to reduce wear on both improved rod guides 98,99 and the well tubing section 95 in which they move. Shock absorbing action in improved rod guides 98,99 can also damp transmission of vibration along a pump rod string (not shown) from its point(s) of origin to susceptible structures such as pump seals and pump bearings (not shown), thus reducing wear in those structures.

Figure 4A:
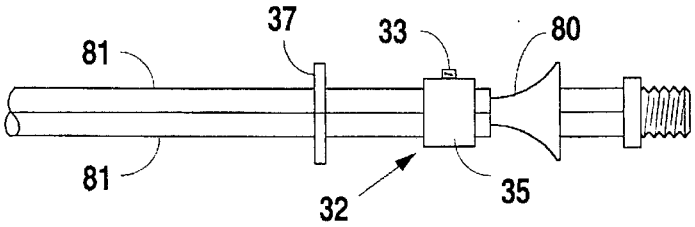
FIG. 4A schematically illustrates a portion of a pump rod with a clamp for fixing two bearing means members around the rod.
Figure 4B:
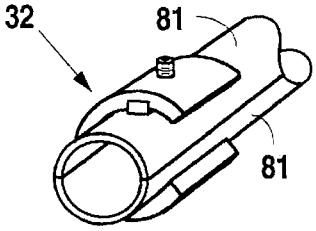
FIG. 4B schematically illustrates an isometric view of a portion of two bearing means members with a clamp for fixing the two members together.
Figure 4C:
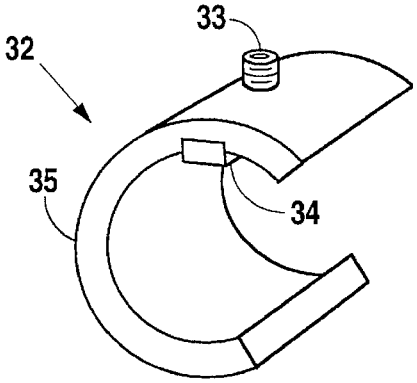
FIG. 4C schematically illustrates an enlarged isometric view of the clamp of FIG. 4B.
Figure 4D:
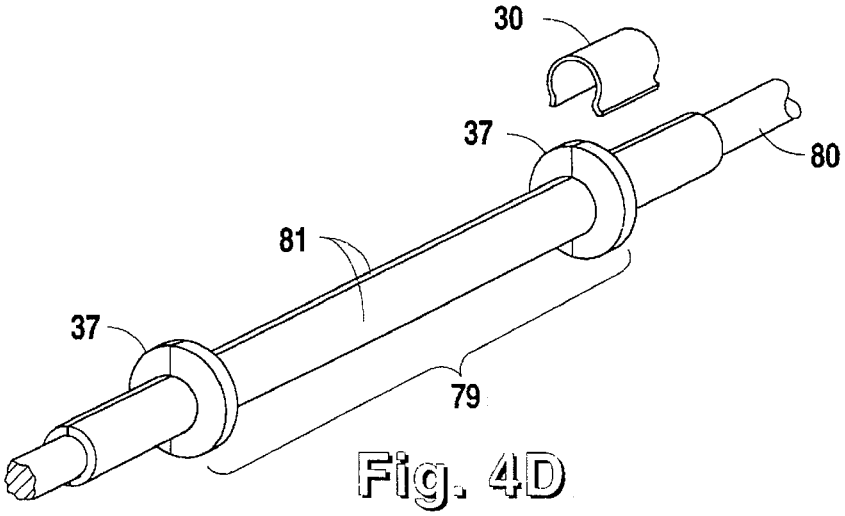
FIG. 4D schematically illustrates a portion of a pump rod with a clip fixing two beating means members around the rod.
Figure 4E:
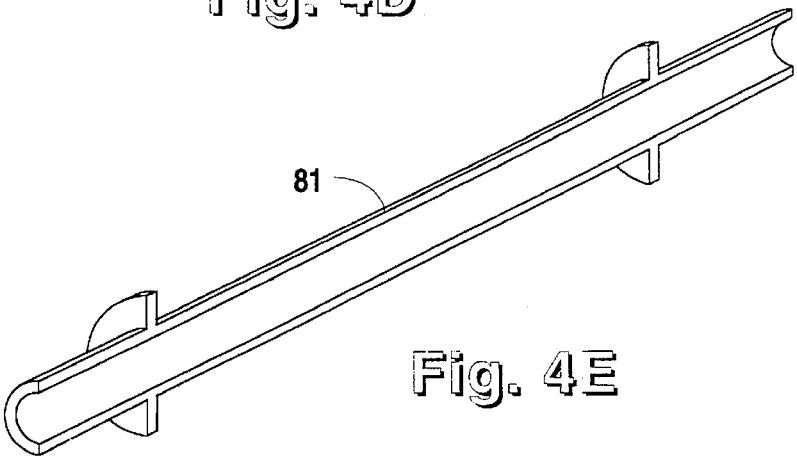
FIG. 4E schematically illustrates a bearing means member.

To reduce cost and improve reliability of certain pump jacks, it may be desirable to eliminate the need for an external rod rotator by allowing substantially free rotation of each improved rod guide 98,99 around the pump rod 80,80'. This may be accomplished by providing sufficient clearance between each tubular rod bearing bore 40,40' and an inner rod bearing race 79,79'79" to create an effective sleeve bearing (preferably for example, in common applications, about 0.003 inch to about 0.010 inch clearance). When such an optional bearing is desired, each rod bearing means additionally comprises an inner rod bearing race 79,79'79" preferably extending substantially the length L,L' of the improved rod guide 98,99, and thrust bearings 37,37',37'" spaced apart so as to allow free rotation of the rod guide about the pump rod 80,80' while limiting movement of the rod guide longitudinally along the pump rod. An inner rod bearing race 79 and two thrust bearings 37 may comprise, for example, two substantially identical bearing means members 81 which are clamped together around a pump rod 80 by a clamp 32 (see FIGS. 4A, 4B and 4C) or clipped together similarly by a clip 30 (see FIG. 4D). Note that clamp 32 preferably comprises an adjusting screw 33 and pressure plate 34 for clamping action around rod 80 without the danger of scoring (and thus weakening) rod 80 by excessive pressure from screw 33. Analogously, an inner race 79' may be formed around a pump rod 80 as, for example, by casting a relatively high-temperature bearing alloy around a portion of a pump rod 80, the casting including thrust bearings 37' contiguous with inner race 79'. Finally, an inner race 79" and thrust bearings 37" can be formed on a pump rod 80 (by machining, for example) to form a modified pump rod 80'. When the outer bearing member 20,23 is thus permitted to rotate substantially freely about a pump rod 80,80', longitudinal slippage of the improved rod guide 98,99 along the rod 80,80' will be limited by thrust bearings 37,37',37".

First and second rod bearing gaps 41,41' respectively are preferably rotationally misaligned (that is, rotated relative to one another about the longitudinal axis). In certain embodiments first and second rod bearing gaps 41,41' respectively are oriented oppositely about the longitudinal axis X—X (the gaps being rotated about 180 degrees from each other) to prevent a pump rod 80,80' which lies within the first and second rod bearing bores 40,40' respectively from being simultaneously forced laterally out of both bores. When any lateral force is applied to a pump rod 80,80' lying longitudinally within the two rod bearing bores 40,40' of an improved rod guide 98,99 (as within a portion of oil well tubing 95), the lateral force may thus be substantially aligned so as to tend to displace the rod 80,80' through at most a single rod beating gap 41 or 41". The remaining rod bearing gap 41' or 41 will preferably not have a similar alignment with the lateral force, which means the remaining rod bearing means will act to prevent simultaneous lateral displacement of the rod 80,80' out of both the first and second rod bearing bores 40,40'. As long as a portion of pump rod 80,80' lies simultaneously within the improved rod guide 98,99 and within a section of well tubing 95, the guide 98,99 will thus prevent direct contact between the rod 80,80' and the tubing 95, and will tend to keep the rod 80,80' substantially centered within the tubing 95.

Figure 7A:
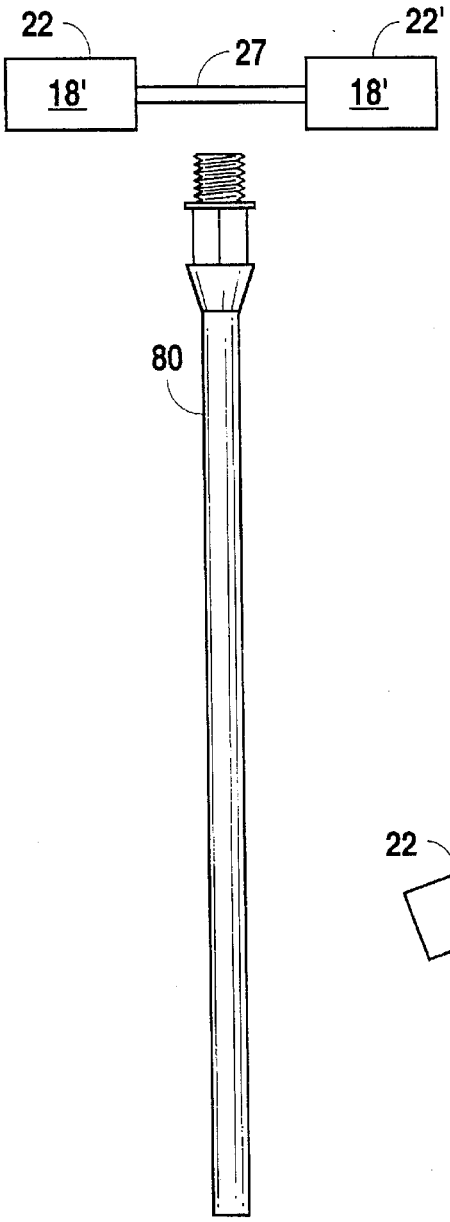
FIGS. 7A, 7B and 7C schematically illustrate an embodiment of the improved rod guide being applied to a pump rod in three successive steps.
Figure 7B:
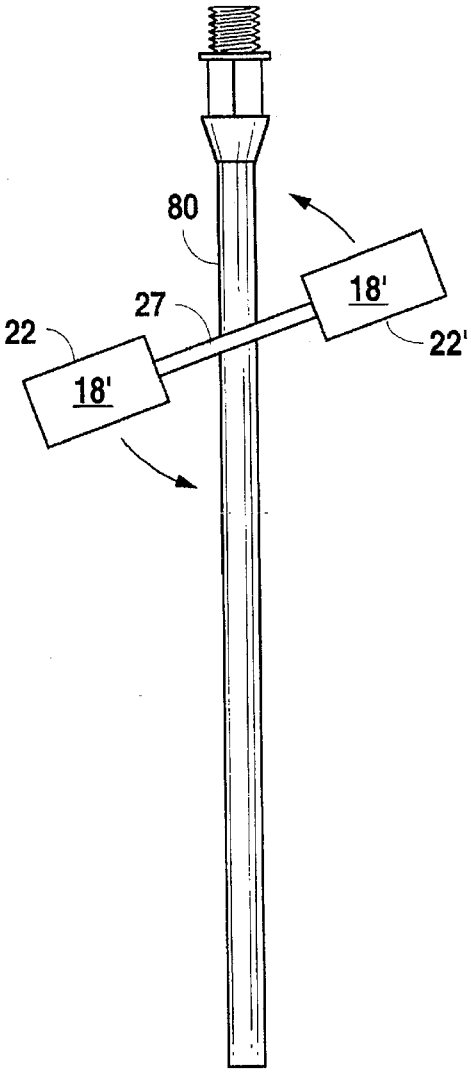
Figure 7C:
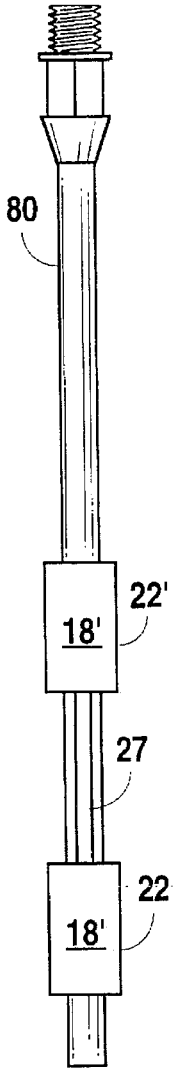

On the other hand, when the improved rod guide 98,99 and a pump rod 80,80' to which the guide 98,99 is applied are withdrawn from (or not yet inserted in) the well tubing 95, the rod guide 98,99 can be rotated about an axis substantially perpendicular to the longitudinal axis X—X. If the two rod bearing gaps 41,41' are oriented about 180 degrees from each other, the respective rod bearing means may be substantially simultaneously applied to the pump rod 80,80' (substantially longitudinally aligned in position for use in a well) or removed from the pump rod 80,80' (substantially transversely aligned in position for separation from a rod section or for initial installation on a rod section, as in FIGS. 7A, 7B and 7C).

Figure 10:
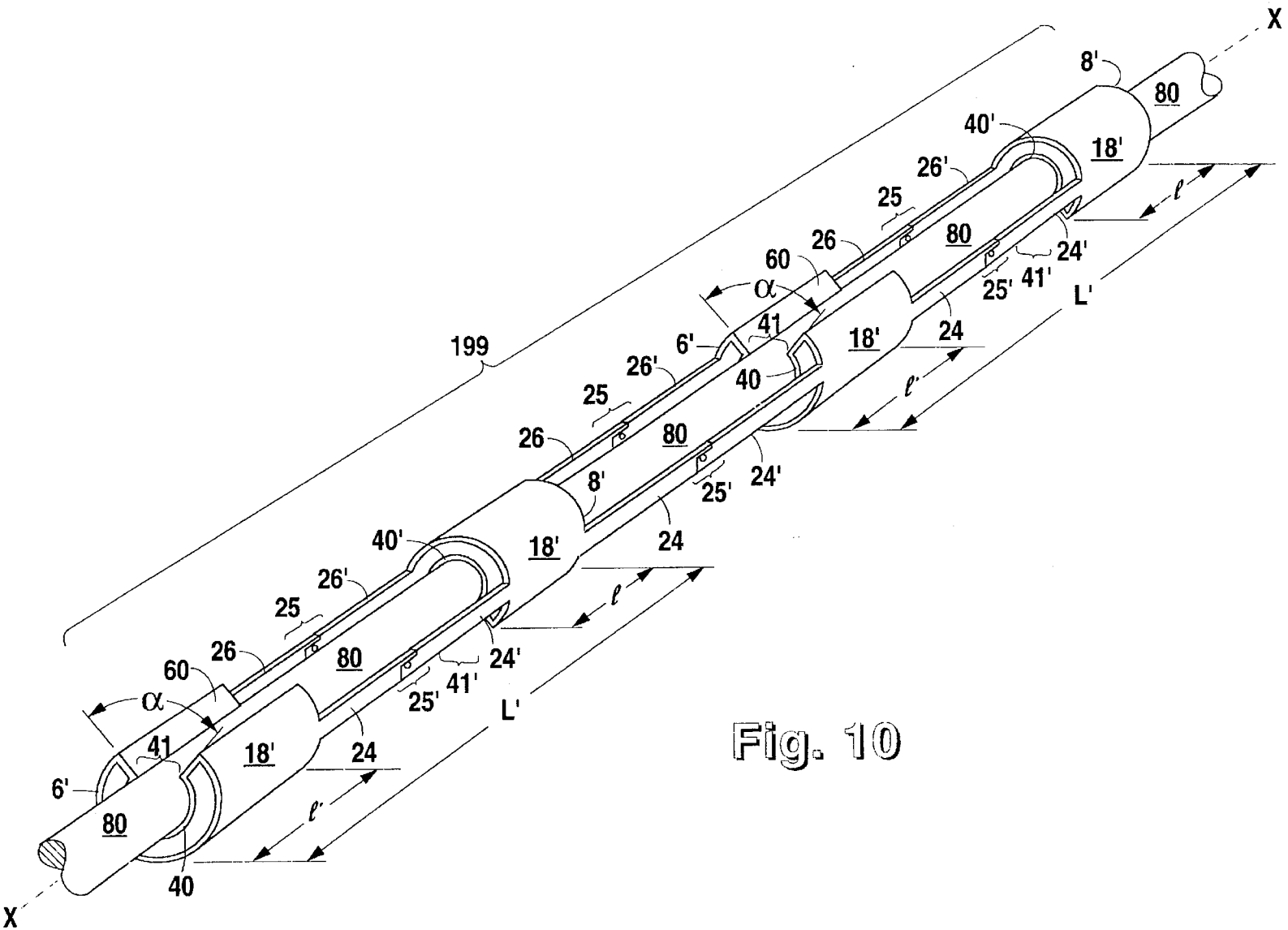
FIG. 10 schematically illustrates a portion of a pump rod over which is placed a compound rod guide.

Note that the necessity for this substantially transverse alignment of the improved rod guide 98 for separation from a rod section or for initial installation can be obviated in embodiment 99 of the invention wherein the outer bearing member substantially comprises first and second corresponding portions 22,22' to which are fixed the first and second rod bearing means respectively, and further comprises a reversible coupling means 25,25' between the corresponding portions 22,22'. Each coupling means 25,25' preferably comprises at least one pair of mating surfaces which can be reversibly fixed together to prevent significant relative longitudinal movement between the surfaces, as by one or more screws and/or pins and/or spring clips. Note that in certain embodiments, coupling means 25,25' may substantially comprise first and second articulated pin joints respectively, which allow substantially free rotation (within a range of motion of, for example, about ±15 degrees with respect to the longitudinal axis) of corresponding portion 22 with respect to corresponding portion 22' about the pin joints. Thus, an improved rod guide comprising first and second corresponding portions 22,22' coupled by coupling means 25,25' (which in turn comprise first and second articulated pin joints respectively) is an articulated rod guide. Note also that in a manner analogous to the joining of corresponding portions 22,22' via coupling means 25,25' in an improved rod guide 99, a plurality of rod guides 99 may be coupled end-to-end via successive coupling means 25,25' to form a compound rod guide 199 (see FIG. 10). Where, in such a compound rod guide, one or more coupling means 25,25' comprise first and second articulated pin joints respectively, the result would be an articulated compound rod guide. Compound rod guides having relatively large total outer bearing surface area may be particularly desirable for use on portions of a pump rod string which is exposed to relatively large lateral forces (compared to such forces in other portions of the well bore) due, for example, to local deviation of the well bore. Articulated compound rod guides may be particularly desirable for reducing the likelihood of fatigue failure in rod guides which experience relatively large lateral forces combined with relatively large longitudinal bending due to local angular deviation of the well bore.

In embodiments of the improved rod guide comprising two or more corresponding portions 22,22', each first and second rod bearing means can be applied separately to a pump rod 80,80' and then coupled (by reversibly coupling respective mating surfaces) via coupling means 25,25'. Each coupling is preferably accomplished at coupling means 25,25' of attenuated (thus, relatively longitudinally compliant) and relatively streamlined (that is, relatively smooth surfaced) regions analogous to 26,26' and 24,24' of each of the corresponding outer bearing member portions 22,22' respectively so as to ensure that when coupling is complete, each pair of first and second longitudinal rod bearing gaps 41,41' will be rotated about 180 degrees from each other (see FIG. 5A). This procedure may be advantageous when it is desired to apply an improved rod guide (including a compound rod guide) to an already-assembled pump rod string. Similarly, clips 30 and/or clamps 32 for fixing two beating means members 81 around pump rod 80, for example, may be applied without need for disassembling a pump rod string.

Figure 6A:
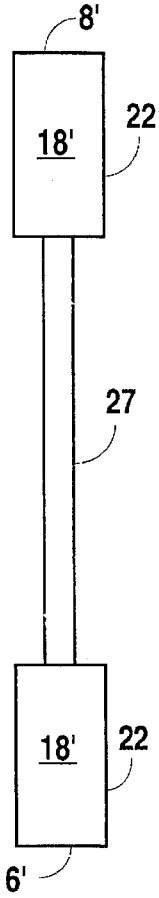
FIG. 6A schematically illustrates an embodiment of the improved rod guide comprising corresponding portions of the outer bearing member joined by a threaded rod.
Figure 6B:
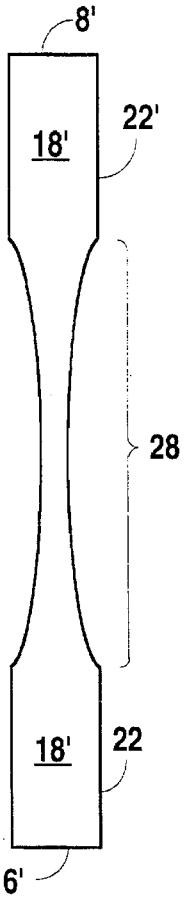
FIG. 6B schematically illustrates an embodiment of the improved rod guide comprising an outer bearing member attenuated between the first and second rod bearing means.
Figure 6C:
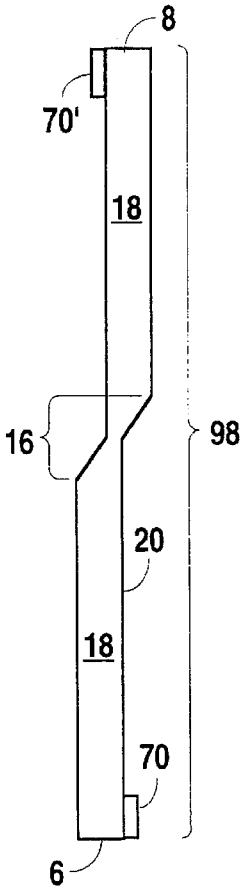
FIG. 6C schematically illustrates an embodiment of the improved rod guide comprising an outer bearing member attenuated between the first and second truncated regions.
Figure 8:
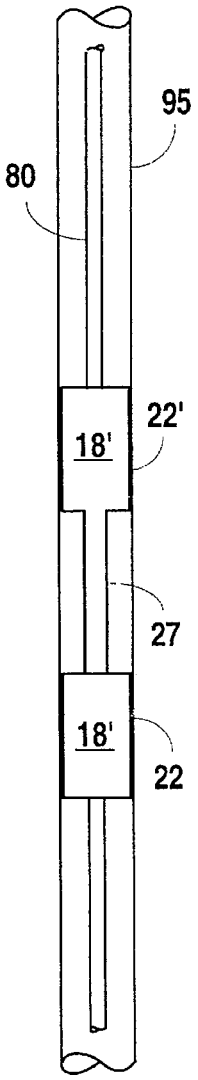
FIG. 8 schematically illustrates a cross-section of a section of well tubing enclosing an embodiment of the improved rod guide over a pump rod.

In embodiments 99 where first and second corresponding portions 22,22' of the outer bearing member 23 are not coupled reversibly as above but instead are substantially permanently coupled, the outer bearing member 23 is preferably attenuated (that is, thinned and/or reduced in width) between the first and second rod bearing means (that is, between the first and second corresponding portions 22,22' respectively—see portion 28 in FIG. 6B) to provide increased compliance to bending forces along the longitudinal axis X—X. In still other preferred embodiments, attenuated portion 28 of the outer bearing member 23 may be replaced with, for example, elongated compliant members 27 such as threaded rods or other reversible and/or adjustable links (including elongated coiled and/or flat springs) which join corresponding portions 22,22' of the outer bearing member 23 to form a complete improved rod guide 99 having increased longitudinal compliance, but where the elongated members 27 do not have outer bearing surfaces themselves. Use of the improved rod guide 99 can, through increased longitudinal compliance, reduce or eliminate binding as the guide 99 moves through curved well bores. Additionally, embodiments of the improved rod guide 99 comprising compliantly coupled first and second corresponding portions 22,22' of the outer bearing member 23 can be applied substantially laterally to an assembled pump rod string without separation of the two corresponding portions 22,22' if the first and second rod bearing gaps 41,41' are rotationally misaligned more than zero degrees but less than about 45 degrees. Greater compliance in coupling of the two corresponding portions 22,22' allows greater rotational misalignment of the two rod bearing gaps 41,41' in embodiments of the improved rod guide 99 adapted for lateral application to a pump rod 80,80'. Any rotational misalignment of the two rod bearing gaps 41,41' greater than zero degrees will tend to limit lateral rod movement with respect to the improved rod guide 99 to a greater extent than commercial "knock on" rod guides limit such movement.

Note that for ease of applying symmetrically truncated embodiments 98 of the improved rod guide to a pump rod 80,80' such as a poney rod, the first and second truncated regions 15,15' respectively of the outer bearing member 20 may overlap longitudinally (see region 16 in FIG. 2A). The degree of overlap required, if any, depends on the diameter and length of any portions of the pump rod 80,80' larger than the diameter of a tubular longitudinal bore 40,40'. A greater degree of overlap will tend to increase compliance to bending forces along the guide's longitudinal axis X—X in a plane substantially perpendicular to the truncating planes. The compliance arises primarily from deformation of attenuated portions of the outer bearing member 20 which lie between the truncated regions (that is, portions in region 16). Ramp-like surfaces created by the truncating planes, together with relative thinning (attenuation) of portions of the outer bearing member 20 between the truncating planes (region 16), which increases with greater overlap, tends to make the improved rod guide 98 self-aligning as it moves into highly curved sections of well bores. The self-alignment will tend to effectively distribute rod forces in the plane of a well bore curve, thus facilitating absorption of the shock of changes in pump rod 80,80' direction of movement by applying such forces to a plurality of points along the well tubing.

What is claimed is:

1. A well tubing and pump rod protector, comprising a substantially hollow outer bearing member having a substantially right circular cylindrical outer bearing surface and having first and second ends, a longitudinal axis, and a length measured along said longitudinal axis between said first and second ends;

first and second rod bearing means spaced apart along said longitudinal axis and fixed substantially coaxially within said outer bearing member surface adjacent said first and second ends respectively, each said rod bearing means comprising a substantially tubular longitudinal bore having a longitudinal rod bearing gap for allowing substantially lateral insertion of a pump rod within each said rod bearing bore, each said rod bearing gap having gap size at each point along said tubular longitudinal rod bearing bore; and first and second centering means for fixing said first and second rod bearing means respectively substantially coaxially within said outer bearing member surface.

2. The well tubing and pump rod protector of claim 1, wherein each said rod bearing gap size is about 90 degrees to about 180 degrees.

3. The well tubing and pump rod protector of claim 1, wherein said gap size for each said rod bearing gap is non-uniform.

4. The well tubing and pump rod protector of claim 1, wherein said first and second rod bearing gaps are rotationally misaligned from each other.

5. The well tubing and pump rod protector of claim 1, wherein each said centering means comprises a substantially solid rod bearing support block.

6. The well tubing and pump rod protector of claim 5, additionally comprising streamlining means extending from at least a portion of said first and second outer bearing member ends.

7. The well tubing and pump rod protector of claim 1, wherein each said centering means comprises at least one rod bearing standoff.

8. The well tubing and pump rod protector of claim 7, wherein each said centering means comprises at least one resilient rod bearing standoff.

9. The well tubing and pump rod protector of claim 1, additionally comprising rod retainer means.

10. The well tubing and pump rod protector of claim 1, wherein each said rod bearing means additionally comprises an inner rod bearing race and two thrust bearings.

11. The well tubing and pump rod protector of claim 10, wherein said inner rod bearing race and thrust bearings are cast on a pump rod.

12. The well tubing and pump rod protector of claim 11, comprising at least one rod bearing standoff oriented substantially longitudinally but with sufficient transverse orientation to function as an internal vane for imparting rotational forces to said outer bearing member during substantially longitudinal fluid flow through fluid paths bounded by said outer bearing member, said tubular rod bearing bore, and said at least one rod bearing standoff.

13. The well tubing and pump rod protector of claim 1, wherein said outer bearing member comprises first and second corresponding portions to which are fixed said first and second rod bearing means respectively, and further comprises reversible coupling means between said corresponding portions for coupling said corresponding portions.

14. The well tubing and pump rod protector of claim 13 wherein said reversible coupling means comprises first and second articulated pin joints.

15. The well tubing and pump rod protector of claim 1, wherein said outer bearing member comprises first and second corresponding portions to which are fixed said first and second rod bearing means respectively, said corresponding portions being joined by adjustable elongated members for increased longitudinal compliance.

16. The well tubing and pump rod protector of claim 1, wherein said outer bearing member is substantially symmetrically truncated by first and second planes, said first plane passing through at least a portion of said first end and at least a portion of said outer bearing surface to define a first truncated region of said outer bearing surface, and said second plane passing through at least a portion of said second end and at least a portion of said outer bearing surface to define a second truncated region of said outer bearing surface, said first and second tubular longitudinal bores being truncated by said first and second truncating planes respectively substantially flush with said outer bearing surface, said first and second truncating planes passing substantially longitudinally through said first and second tubular longitudinal bores respectively.

17. The well tubing and pump rod protector of claim 16, additionally comprising first and second rod retainer means reversibly coupled to said first and second tubular rod bearing bores respectively for reversibly retaining a substantially axial rod within said first and second tubular rod bearing bores.

18. The well tubing and pump rod protector of claim 16, wherein said first and second truncating planes are curved.

19. The well tubing and pump rod protector of claim 16, wherein said first and second truncated regions of said outer bearing member overlap longitudinally.

20. The well tubing and pump rod protector of claim 1, wherein said outer bearing member and said first and second tubular rod bearing bores substantially comprise mild steel.

21. The well tubing and pump rod protector of claim 1, wherein said outer bearing member comprises first and second corresponding portions to which are fixed said first and second rod bearing means respectively, said corresponding portions being substantially permanently coupled and said outer bearing member being attenuated between said first and second rod bearing means.

22. A section of well tubing containing the well tubing and pump rod protector of claim 1 and a pump rod.

23. A section of well tubing containing the well tubing and pump rod protector of claim 16 and a pump rod.

24. A pump rod to which is fixed at least one well tubing and pump rod protector of claim 1.

25. A pump rod to which is fixed at least one well tubing and pump rod protector of claim 16.

26. A method of protecting well tubing and pump rod from excessive wear associated with substantially longitudinal movement of the pump rod within the well tubing, the method comprising applying at least one well tubing and pump rod protector as described in claim 1 to a pump rod which moves substantially longitudinally within the well tubing, said outer bearing surface forming an effective bearing for substantially longitudinal movement of the pump rod within the well tubing.

27. A method of making a well tubing and pump rod protector, the method comprising providing an elongated and substantially hollow outer bearing member having first and second ends;

spacing first and second rod bearing means apart within said outer bearing member; and fixing with first and second centering means said first and second rod bearing means respectively substantially coaxially within said outer bearing member.

* * * * *